US008681183B2

(12) United States Patent
Park et al.

(10) Patent No.: US 8,681,183 B2
(45) Date of Patent: Mar. 25, 2014

(54) APPARATUS AND METHOD FOR DRIVING A DISPLAY PANEL AND DISPLAY APPARATUS HAVING THE APPARATUS

(75) Inventors: Bong-Im Park, Cheonan-si (KR); Hoi-Sik Moon, Cheonan-si (KR); Bong-Ju Jun, Cheonan-si (KR); Jae-Won Jeong, Seoul (KR); Yong-Jun Choi, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 808 days.

(21) Appl. No.: 12/399,572

(22) Filed: Mar. 6, 2009

(65) Prior Publication Data

US 2009/0225105 A1 Sep. 10, 2009

(30) Foreign Application Priority Data

Mar. 6, 2008 (KR) ..... 10-2008-0020889

(51) Int. Cl.
*G09G 5/10* (2006.01)

(52) U.S. Cl.
USPC ..... 345/690

(58) Field of Classification Search
USPC ..... 345/690
See application file for complete search history.

(56) References Cited

U.S. PATENT DOCUMENTS

2007/0273677 A1* 11/2007 Kim ..... 345/204
2007/0296669 A1* 12/2007 Jeon et al. ..... 345/89
2008/0036718 A1* 2/2008 Lee ..... 345/88

* cited by examiner

*Primary Examiner* — Quan-Zhen Wang
*Assistant Examiner* — Nelson D Runkle, III
(74) *Attorney, Agent, or Firm* — Cantor Colburn LLP

(57) ABSTRACT

A display apparatus includes a display panel, a timing controller and a data driver. The display panel includes a plurality of unit pixels respectively including a first sub-pixel and a second sub-pixel. The timing controller includes a first compensation unit which receives grayscale data corresponding to the unit pixels and generates first compensation data of the grayscale data using offset values of first sample compensation data sampled from a first gamma curve. The data driver includes a second compensation unit which generates second compensation data of the grayscale data using second sample compensation data sampled from a second gamma curve and the first compensation data. Accordingly, the first and second compensation data comprise color compensation data, which improve image quality. A method for driving the display panel of the display apparatus is also provided.

20 Claims, 7 Drawing Sheets

| 10-bit FIRST SAMPLE GRAYSCALE | 12-bit FIRST SAMPLE COMPENSATION | OFFSET VALUE |
|---|---|---|
| 0 | -2047 | 0 |
| 4 | -1996 | 51 |
| 8 | -1872 | 124 |
| 12 | -1744 | 128 |
| 16 | -1636 | 108 |
| 20 | -1544 | 92 |
| 24 | -1464 | 80 |
| 28 | -1396 | 68 |
| 32 | -1336 | 60 |
| 36 | -1284 | 52 |
| 40 | -1236 | 48 |
| 44 | -1192 | 44 |

APPARATUS AND METHOD FOR DRIVING A DISPLAY PANEL AND DISPLAY APPARATUS HAVING THE APPARATUS

This application claim priority to Korean Patent Application No. 2008-20889, filed on Mar. 6, 2008, and all the benefits accuring therefrom under 35 U.S.C. §119, the contents of which in its entirety are herein incorporated by reference.

BACKGROUND OF THE INVENTION

1. Field of the Invention

The present invention relates to an apparatus and method for driving a display panel, and a display apparatus having the same. More particularly, the present invention relates to an apparatus and method for driving a display panel for a display apparatus, and a display apparatus having the apparatus for driving the display panel.

2. Description of the Related Art

A liquid crystal display ("LCD") apparatus includes two opposite substrates and a liquid crystal layer interposed between the two opposite substrates. When an electric field is applied to the liquid crystal layer, the LCD displays an image.

A conventional LCD has a narrow viewing angle because the liquid crystal layer transmits light in a predetermined direction and the LCD displays the image using the light. In order to solve the narrow viewing angle problem of the LCD, a vertical alignment ("VA") mode LCD has been previously developed.

The VA mode LCD includes a lower substrate, an upper substrate opposite to the lower substrate and a liquid crystal layer, which includes negative dielectric anisotropy, interposed between the lower substrate and the upper substrate. Liquid cyrsal molecules in the liquid crystal layer are aligned so that their major axes are perpendicularly orientated to the lower substrate and the upper substrate. When an electric field is not applied to the liquid crystal layer, the liquid crystal molecules of the liquid crystal layer are vertically aligned in accordance with the lower substrate so that the LCD displays a black image. However, when an electric field having a predetermined intensity is applied to the liquid crystal layer, the liquid crystal molecules are horizontally aligned in accordance with the lower substrate so that the LCD displays a white image. Thus, when an electric field having an intensity smaller than the predetermined intensity is applied to the liquid crystal layer, the liquid crystal molecules are inclined in accordance with the lower substrate so that the LCD displays a gray image.

The VA mode LCD has a relatively narrow viewing angle. In order to solve the narrow viewing angle problem of the VA mode LCD, a patterned vertical alignment ("PVA") mode LCD has been developed. The PVA mode LCD includes a color filter substrate having a common electrode which is patterned to have multiple domains, and an array substrate having a plurality of patterned sub-pixel electrodes. Recently, a super-PVA ("SPVA") mode LCD has been previously developed. In the SPVA mode LCD, different voltages are respectively applied to the sub-pixel electrodes in accordance with different gamma curves.

The LCD implements an accurate color capture ("ACC") technology to improve image quality using a lookup table storing data and color compensation data of the data.

When the ACC technology having a single lookup table is implemented in the SPVA mode LCD, the same ACC technology is applied to sub-pixels receiving different pixel voltages according to the different gamma curves. Accordingly, when the image is viewed from the side, the image may look yellowish.

Thus, it is desired to develop a display apparatus, and method and apparatus for driving a display panel of a display apparatus that improves image quality.

BRIEF SUMMARY OF THE INVENTION

An exemplary embodiment of the present invention provides a method of driving a display panel capable of improving image quality.

Another exemplary embodiment of the present invention provides an apparatus for driving the display panel capable of performing the method.

In yet another exemplary embodiment of the present invention provides a display apparatus having the apparatus for driving the display panel.

According to an exemplary embodiment of the present invention, there is provided a display apparatus. The display apparatus includes a display panel having a plurality of unit pixels, a timing controller and a data driver. Each of the unit pixels includes a first sub-pixel and a second sub-pixel. The first sub-pixel is electrically connected to a data line and receives a first gate signal through a first gate line. The second sub-pixel is electrically connected to the data line and receives a second gate signal through a second gate line adjacent to the first gate line. The timing controller includes a first compensation unit which receives grayscale data corresponding to the unit pixels and generates first compensation data of the grayscale data using offset values of first sample compensation data sampled from a first gamma curve. The data driver includes a second compensation unit which generates second compensation data of the grayscale data using second sample compensation data sampled from a second gamma curve and the first compensation data. The first compensation data is transferred to the first sub-pixel through the data line when the first sub-pixel is turned on by the first gate signal, and the second compensation data is transferred to the second sub-pixel through the data line when the second sub-pixel is turned on by the second gate signal.

According to another exemplary embodiment of the present invention, there is provided an apparatus for driving a display panel. The apparatus includes a timing controller and data driver. The timing controller includes a first compensation unit which generates first compensation data of grayscale data using an offset value of first sample data sampled from a first gamma curve. The data driver includes a second compensation unit which generates second compensation data of the grayscale data using second sample compensation data sampled from a second gamma curve and the first compensation data, and a digital-to-analog converter ("DAC") which converts the first and second compensation data into first and second analog data signals.

According to yet another exemplary embodiment of the present invention, there is provided a method of driving a display panel. In the method of driving the display panel, first compensation data of grayscale data is generated using offset values of first sample compensation data sampled from a first gamma curve. The first compensation data is converted into a first analog data signal and the first analog data signal is output to a data line of a display panel. Then, second compensation data of the received grayscale data is generated using second sample compensation data sampled from a second gamma curve and the first compensation data. The second compensation data is converted into a second analog data signal and the second analog data signal is output to the data line.

Accordingly, image quality may be improved since different color compensation data is applied to sub-pixels for multiple domains. Also, storage capacity of a storage device may be reduced to decrease manufacturing costs.

BRIEF DESCRIPTION OF THE DRAWINGS

The above and other aspects, features and advantages of the present invention will become more readily apparent by describing in further detail exemplary embodiments thereof with reference to the accompanying drawings, in which.

DETAILED DESCRIPTION OF THE INVENTION

Figure 1:
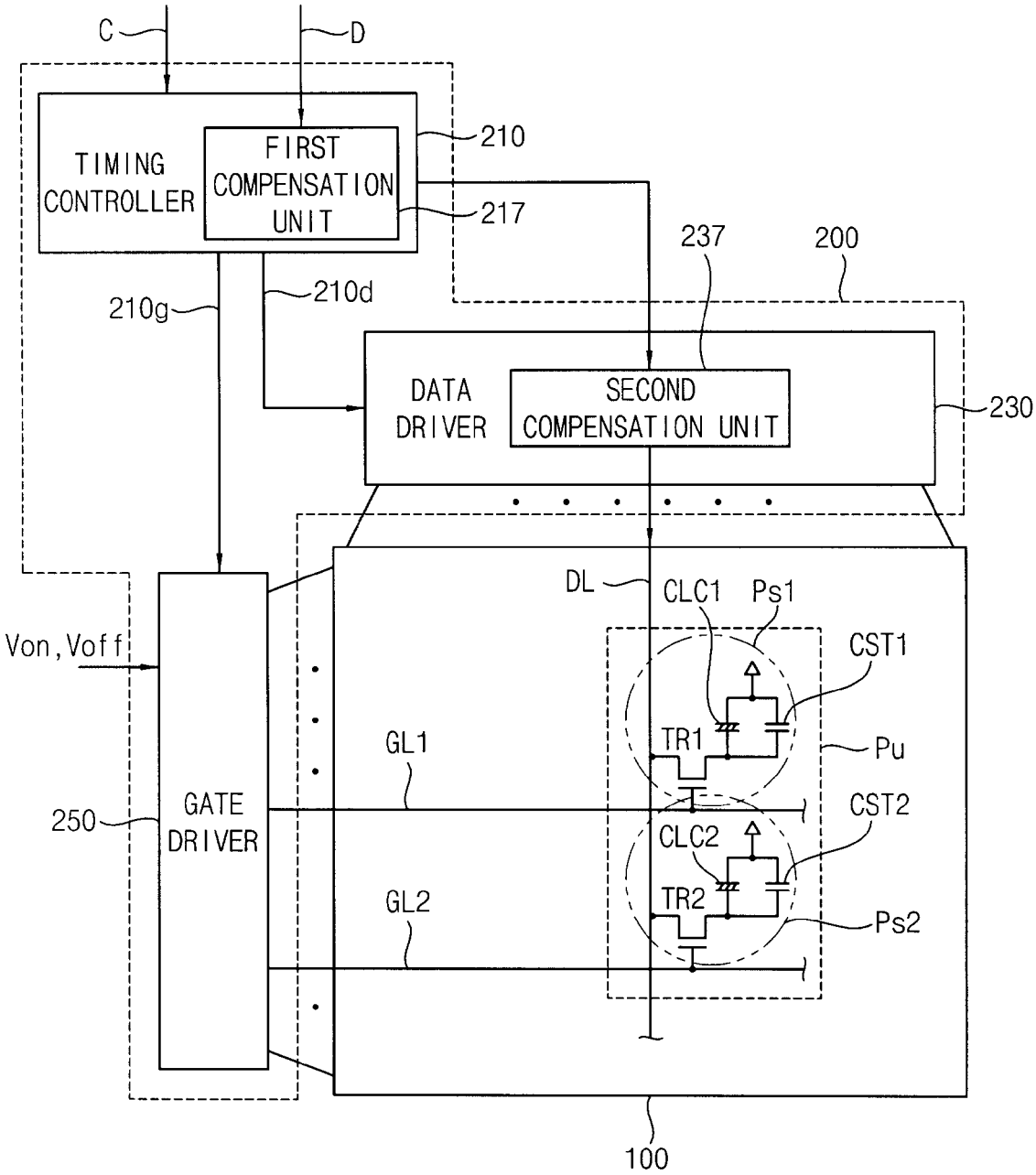
FIG. 1 is a block diagram illustrating a display apparatus in accordance with an exemplary embodiment of the present invention.

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

Hereinafter, exemplary embodiments of the present invention will be explained in detail with reference to the accompanying drawings.

Figure 2:
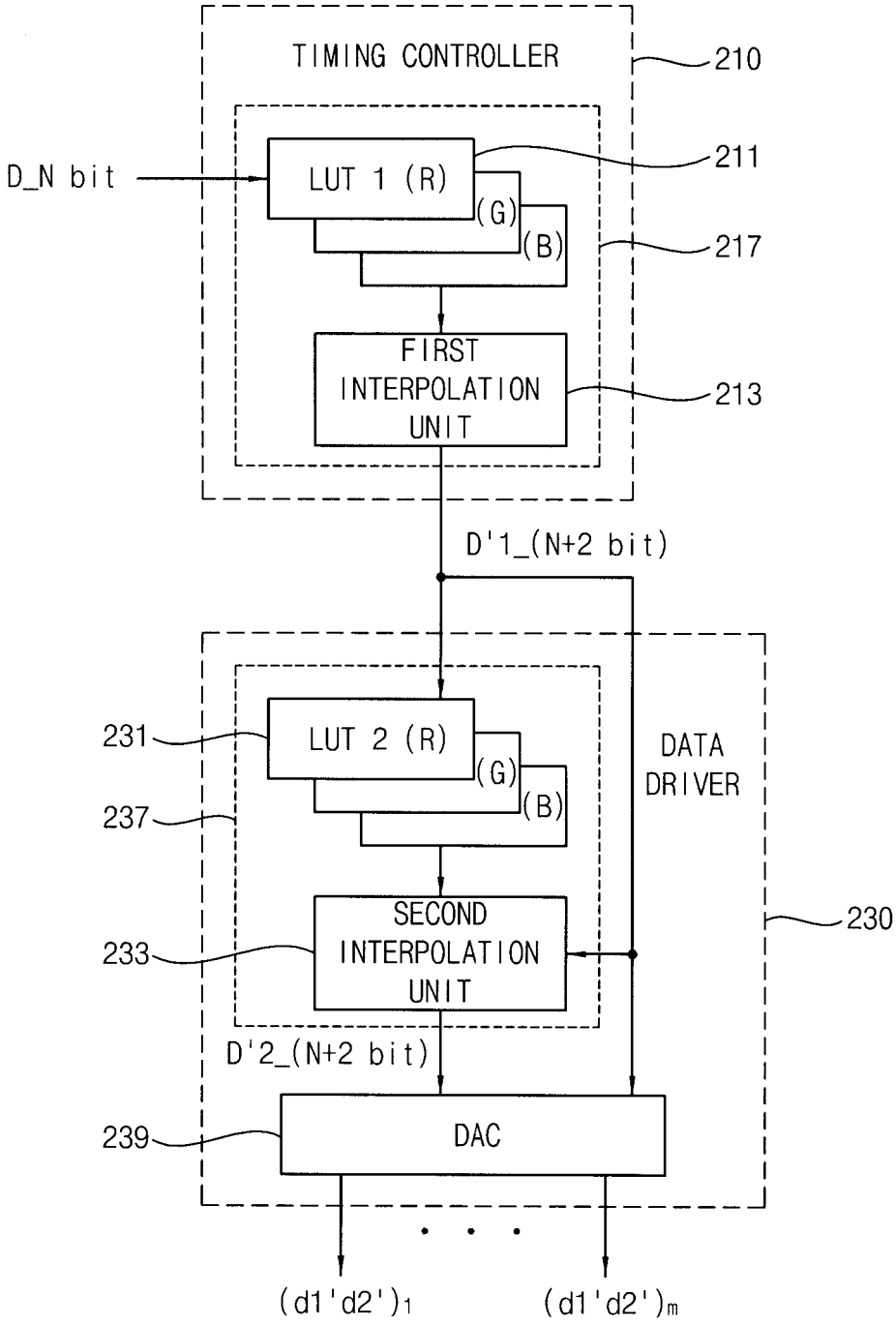
FIG. 2 is a more detailed block diagram illustrating a driving device illustrated in FIG. 1.

FIG. 1 is a block diagram illustrating a display apparatus in accordance with an exemplary embodiment of the present invention. FIG. 2 is a detailed block diagram illustrating a driving device illustrated in FIG. 1.

Referring to FIGS. 1 and 2, the display apparatus includes a display panel 100 and a driving device 200 which drives the display panel 100.

In further detail, the display panel 100 includes a plurality of unit pixels Pu. Each of the unit pixels Pu includes a first sub-pixel Ps1 and a second sub-pixel Ps2.

The first sub-pixel Ps1 receives a first gate signal through a first gate line GL1 and is electrically connected to a data line DL. The second sub-pixel Ps2 receives a second gate signal through a second gate line GL2, which is adjacent to the first gate line GL1 and is electrically connected to the data line DL.

In an exemplary embodiment of the present invention, the first sub-pixel Ps1 may include a first transistor TR1, a first liquid crystal capacitor CLC1 and a first storage capacitor CST1. The first transistor TR1 may be electrically connected to the first gate line GL1 and the data line DL. The first liquid crystal capacitor CLC1 and the first storage capacitor CST1 may be electrically connected to the first transistor TR1. The second sub-pixel Ps2 may include a second transistor TR2, a second liquid crystal capacitor CLC2 and a second storage capacitor CST2. The second transistor TR2 may be electrically connected to the second gate line GL2 and the data line DL. The second liquid crystal capacitor CLC2 and the second storage capacitor CST2 may be electrically connected to the second transistor TR2.

Still referring to FIGS. 1 and 2, the driving device 200 of the display apparatus includes a timing controller 210, a data driver 230 and a gate driver 250.

The timing controller 210 receives a control signal C and grayscale data D from an external device (not illustrated). The timing controller 210 generates timing control signals including data control signals and gate control signals for controlling a driving time of the data driver 230 and the gate driver 250 by using the received control signal C. The timing controller 210 outputs the data control signals 210*d* and the gate control signals 210*g* to the data driver 230 and the gate driver 250, respectively. The timing controller 210 includes a first compensation unit 217. The first compensation unit 217 generates first compensation data D'1 for compensating the grayscale data by using first sample compensation data sampled from a first gamma curve. The first sample compensation data is sampled from the first gamma curve using the grayscale data D. The first compensation unit 217 outputs the first compensation data D'1 to the data driver 230.

Sill referring to FIGS. 1 and 2, the data driver 230 converts the first compensation data D'1 applied from the first compensation unit 217 into a first analog data signal d'1 and outputs the first data signal d'1 to the data line DL of the display panel 100. The data driver 230 includes a second compensation unit 237. The second compensation unit 237 generates second compensation data D'2 using the first compensation data D'1 and second sample compensation data sampled from a second gamma curve, which is different from the first gamma curve. The data driver 230 converts the second compensation data D'2 into a second analog data signal d'2 and outputs the second analog data signal d'2 to the data line DL of the display panel 100.

For example, the first compensation unit 217 may generate the first compensation data D'1 using an offset value of the first sample compensation data, which is sampled from the first gamma curve. The data driver 230 may convert the first compensation data D'1 into the first data signal d'1. During an initial half-period of a horizontal period during which the first sub-pixel Ps1 is driven, the data driver 230 may output the first data signal d'1 to the data line DL according to the control of the data control signal 210*d*.

For example, the second compensation unit 237 may generate the second compensation data D'2 using the second sample compensation data sampled from the second gamma curve. The data driver 230 may convert the second compensation data into the second data signal d'2. During a latter half-period of the horizontal period, during which the second sub-pixel Ps2 is driven, the data driver 230 may output the second data signal d'2 to the data line DL according to the control of the control data 210*d*.

The gate driver 250 generates a gate signal using a gate control signal 210*g*, which is received from the timing controller 210, and a gate-on voltage and a gate-off voltage, which are applied from an external device. For example, the gate driver 250 may output a first gate signal, which is the gate-on voltage, to the first gate line GL1 electrically connected to the first transistor TR1 during the initial half-period of the horizontal period. The gate driver 250 may also output a second gate signal, which is the gate-on voltage, to the second gate line GL2 electrically connected to the second transistor TR2, during the latter half-period of the horizontal period.

During the initial half-period of the horizontal period, the first sub-pixel Ps1 is turned on and receives the first compensation data D'1. During the latter half-period of the horizontal period, the second sub-pixel Ps2 is turned on and receives the second compensation data D'2. Because the first and second sub-pixels Ps1 and Ps2 receive the first and second compensation data D'1 and D'2, the unit pixel Pu may include multiple domains.

In addition, the first and second sub-pixels Ps1 and Ps2 are driven using first and second compensation data D'1 and D'2, which are color compensation data for the first and second gamma curves that are different from each other. Accordingly, in the first and second sub-pixels Ps1 and Ps2, a color coordinate value of each color viewed from the front may be substantially the same as a color coordinate value of each of the colors viewed from the side. As a result, a yellowish phenomenon, in which an image viewed from the side looks yellowish, may be prevented.

Figure 3:
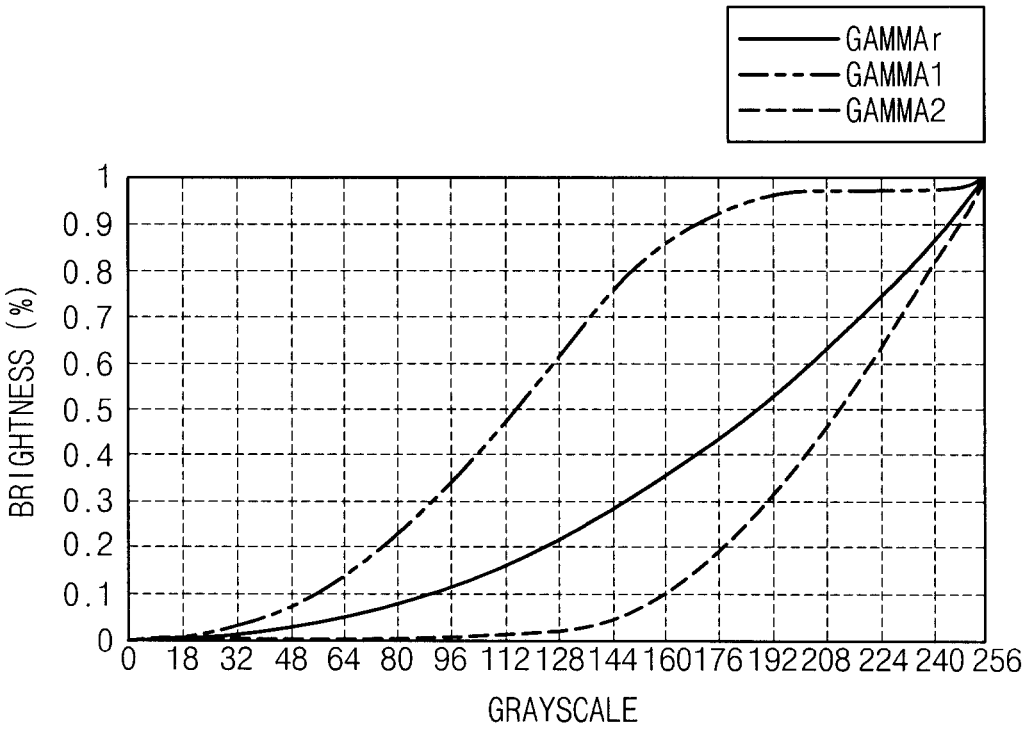
FIG. 3 is a graph illustrating a gamma curve applied to first compensation data and second compensation data.

FIG. 3 is a graph illustrating a gamma curve applied to the first compensation data and second compensation data.

Referring to FIGS. 1 to 3, the driving device 200 includes the timing controller 210 and the data driver 230. The timing controller 210 includes a first compensation unit 217. The first compensation unit 217 includes a first storage unit 211 and a first interpolation unit 213. For example, the timing controller 210 may include one chip comprising the first compensation unit 217.

The data driver 230 may include a second compensation unit 237 and a digital-to-analog converter (DAC) 239. The second compensation unit 237 may include a second storage unit 231 and a second interpolation unit 233. For example, the data driver 230 may include one chip which includes the second compensation unit 237 and the DAC 239.

In the gamma curve shown in FIG. 3, the x-axis refers to the grayscale and the y-axis refers to brightness or transmissivity. The reference gamma curve GAMMAr represents a gamma curve optimized for front visibility and the first and second gamma curves GAMMA1 and GAMMA2 represent gamma curves optimized for side visibility.

The first compensation unit 217 applies received grayscale data D of N bits to the first gamma curve to generate the first compensation data D'1 of N+k bits, where the value of k is a natural number. Hereinafter, example embodiments of the present invention will be described in which the value of k is 2.

The first storage unit 211 includes a first lookup table LUT1 which stores the grayscale data D corresponding to the unit pixels Pu and the offset value of the first sample compensation data sampled from the first gamma curve corresponding to the grayscale data D. The unit pixels Pu may include a red unit pixel ("R"), a green unit pixel ("G") and a blue unit pixel ("B").

For example, $2^M$ offset values of the first sample compensation data are stored in the first lookup table LUT1 of the first storage unit 211 for the R, G and B unit pixels. The $2^M$ first sample compensation data D'1 for the R, G and B unit pixels include positive first sample compensation data +D'1 of the R, G and B unit pixels and negative first sample compensation data −D'1 of the R, G and B unit pixels. Thus, the first storage unit 211 may have a capacity of [$2^M$×3(the number of R, G and B)×2(the number of +D'1 and −D'1)×q] bits, where the value of q is the number of bits of the offset values and is an empirical value. The value of M may be the same as the value of q.

The N-bit grayscale data represents [$2^N$×3(the number of R, G and B)] grayscales and requires a capacity of [$2^N$×3(the number of R, G and B)×2(the number of +D'1 and −D'1)×p] bits to store the gamma curve corresponding to the grayscale data. When M and q are respectively smaller than N and p, the receiving capacity of the lookup table for storing the gamma curve through sampling the gamma curve may be reduced.

The first interpolation unit 213 calculates the first compensation data D'1 for the R, G and B unit pixels having a positive pole and a negative pole and corresponding to the grayscale data D using the offset values stored in the first lookup table LUT1. The first compensation data D'1 calculated from the first interpolation unit 213 is provided to the second compensation unit 237 of the data driver 230.

The second compensation unit 237 generates second compensation data D'2 by converting the first compensation data D'1. The second compensation data D'2 is data of (N+2) bits.

The second sample compensation data of (N+2) bits corresponding to the $2^L$×3(the number of R, G and B) second sample grayscale data is stored in the second lookup table LUT2 of the second storage unit 231 for the R, G and B unit pixels. (N>M>L, and N, M and L are natural numbers.)

The second lookup table LUT2 of the second storage unit 231 may be used for both the positive and negative first compensation data D'1. The second storage unit 231 may have a capacity of $2^L$×3(the number of R, G and B)×12 bits.

The second interpolation unit 233 calculates the second compensation data D'2 of the grayscale data D using the second sample compensation data received in the second storage unit 231 and the first compensation data D'1 provided by the first compensation unit 217.

For example, the second compensation data D'2(*i*) for i-th grayscale data may be defined by the following equation.

$$D'2(i) = \frac{(D'1(i) - D'1(n1))}{(D'1(n+1)) - (D'1(n))} \times (D'2(n+1) - D'2(n)) + D'2(n) \quad \text{[Equation 1]}$$

where D'2(*n*) and D'2(*n*+1) respectively comprise n-th and (n+1)-th second sample compensation data stored in the second storage unit 231, D'1(*n*), D'1(*i*), D'1(*n*+1) respectively comprise n-th, i-th and (n+1)-th first compensation data provided by the first compensation unit 217, where the value of i and n comprises natural numbers, and i comprises a number between n and (n+1).

The first compensation unit 217 and second compensation unit 237 may generate the first compensation data D'1 and second compensation data D'2, which respectively correspond to the first sub-pixels Ps1 and second sub-pixel Ps2, and have (N+2) bits by using grayscale data D of N bits corresponding to the unit pixel Pu. The first and second compensation data D'1 and D'2 are respectively converted into the first and second analog data signals d'1 and d'2 by the DAC 239.

A linear DAC such as a cyclic DAC ("C-DAC") may serve as the DAC 239. Alternatively, a non-linear DAC such as a resistance DAC ("R-DAC") may serve as the DAC 239. When the non-linear DAC serves as the DAC 239, the first and second compensation data D'1 and D'2 having (N+2) bits may be dithered into the first and second compensation data having N bits, and then the first and second compensation data may be converted into the analog data signals using the non-linear DAC.

The data driver 230 outputs the first analog data signal d'1 and then outputs the second analog data signal d'2 since the first compensation unit 217 is driven and then the second compensation unit 237 is driven.

Because the first storage unit 211 stores the offset values of the first sample grayscale data which is sampled from the grayscale data of N bits, the first storage unit 211 may require a reduced storage capacity. Additionally, because the second storage unit 231 stores the second sample compensation data, which corresponds to the second sample grayscale data sampled from the first sample grayscale data, the second storage unit 231 may require a storage capacity that is much smaller than that of the first storage unit 211.

Accordingly, the storage capacities of the first and second storage units may be reduced. Also, the yellowish phenomenon may be prevented because the first and second sub-pixels Ps1 and Ps2 are driven using the first and second compensation data D'1 and D'2 in which two different gamma curves are applied. Further, manufacturing costs may be reduced.

Figure 8:
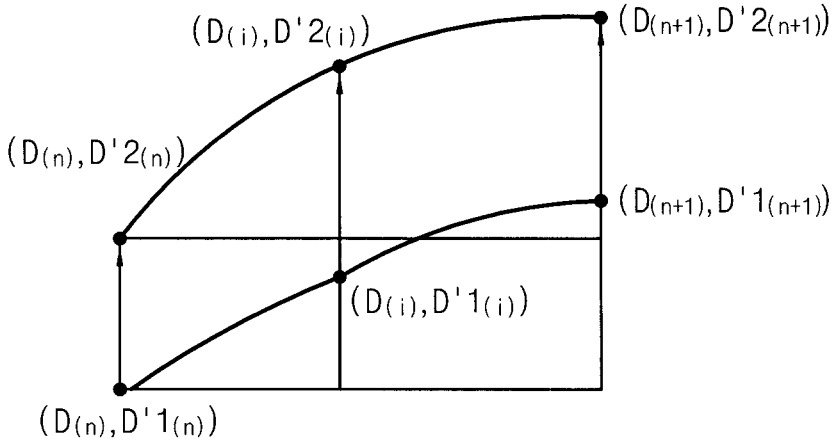
FIG. 8 is a concept diagram illustrating a method of interpolation of a second interpolation unit.

Hereinafter, a method of driving the driving device will be described by referring to FIGS. 4 and 8.

Figure 4:
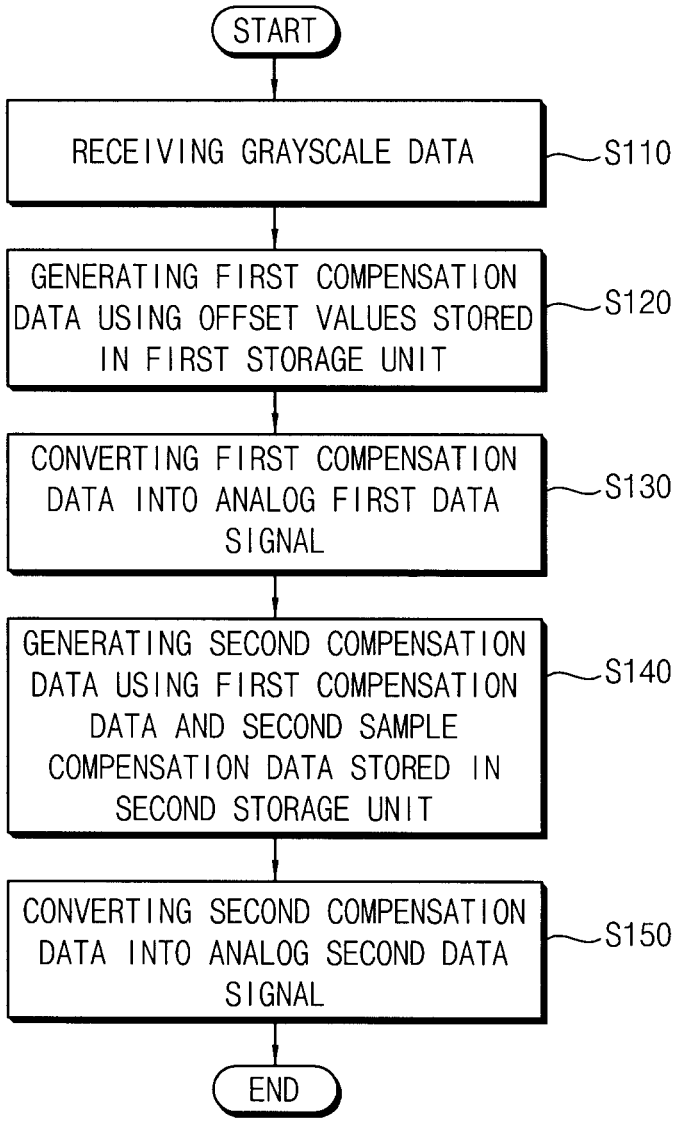
FIG. 4 is a flowchart illustrating a method of driving the driving device illustrated in FIG. 2.
Figures 5, 6:
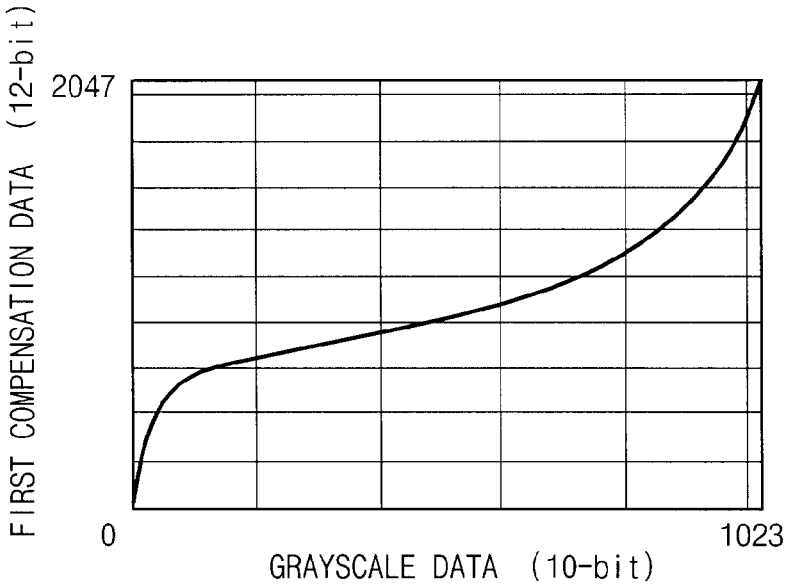
FIG. 5 is a graph illustrating a relationship between grayscale data and the first compensation data.
FIG. 6 is a concept diagram illustrating a lookup table stored in a first storage unit.
Figure 7A:
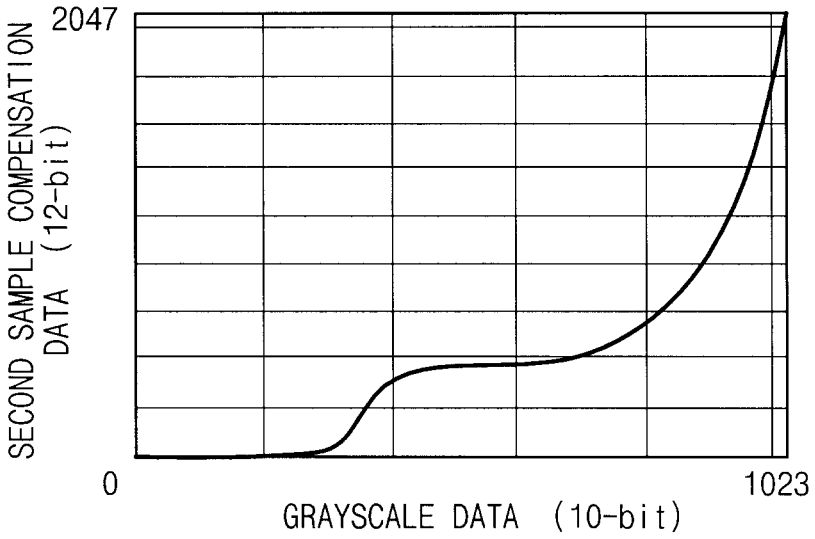
FIG. 7A is a graph illustrating a relationship between the grayscale data and the second compensation data.
Figure 7B:
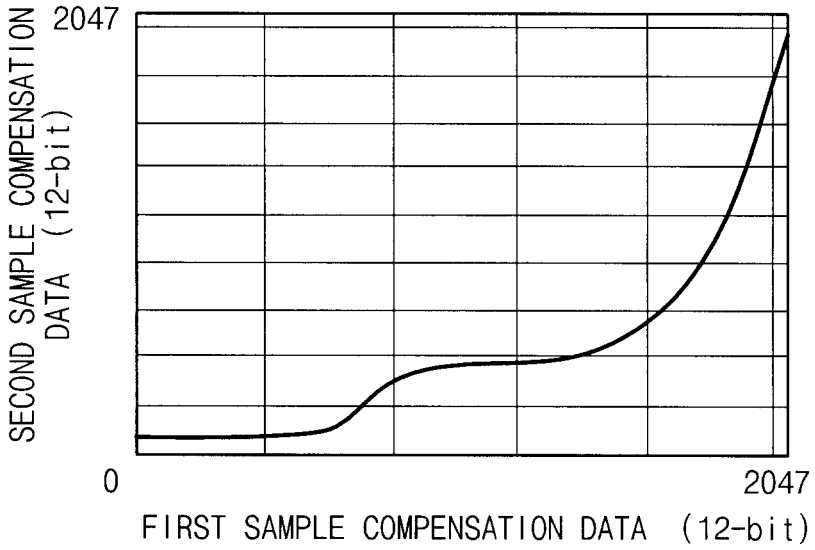
FIG. 7B is a graph illustrating a relationship between first sample compensation data and second sample compensation data.

FIG. 4 is a flowchart illustrating a method of driving the driving device illustrated in FIG. 2. FIG. 5 is a graph illustrating a relationship between grayscale data and the first compensation data. FIG. 6 is a concept diagram illustrating a lookup table stored in a first storage unit. FIG. 7A is a graph illustrating a relationship between the grayscale data and the second compensation data. FIG. 7B is a graph illustrating a relationship between first sample compensation data and second sample compensation data. FIG. 8 is a concept diagram illustrating a method of interpolation of a second interpolation unit.

Referring to FIG. 2 and FIG. 4, the timing controller 210 receives the grayscale data D(i) of 10 bits (step S110).

The grayscale data D(i) is applied to the first compensation unit 217 and the first compensation unit 217 generates the first compensation data D'1(*i*) representing colors compensated by the first gamma curve (step S120).

The first interpolation unit 213 calculates the first compensation data D'1(*i*) corresponding to the grayscale data D(i) by using the offset values of the first sample compensation data D'1 stored in the first storage unit 211.

For example, in FIG. 5, the grayscale data D is 10 bits long and the first compensation data D'1 is 12 bits long and is compensated using the first gamma curve. FIG. 5 illustrates the relationship between the grayscale data D and the first compensation data D'1. The offset values shown in FIG. 6 are stored in the first lookup table LUT1 of the first storage unit 211. For example, the first storage unit 211 stores the first sample compensation data corresponding to 256 ($2^5$) first sample grayscale data sampled from 1024 ($2^{10}$) grayscale data D. The offset values may be empirical values to have various bits. For example, the offset values may be 8 bits. The first interpolation unit 213 calculates the first compensation data D'1(*i*) of the grayscale data D(i) using the offset values stored in the first lookup table LUT1.

The DAC 239 receives the first compensation data D'1(*i*) and converts the received first compensation data D'1(*i*) into the first analog data signal d'1(*i*). The DAC 239 outputs the first analog data signal d'1(*i*) to the data line DL electrically connected to the unit pixel Pu (step S130).

The gate signal corresponding to the gate-on voltage is applied to the first gate line GL1 electrically connected to the first sub-pixel Ps1 of the unit pixel Pu, while the first analog data signal d'1(*i*) is applied to the data line DL. Therefore, the first sub-pixel Ps1 is driven.

The first compensation data D'1(*i*) is inputted to the second compensation unit 237 of the data driver 230.

The second storage unit 231 stores the second sample compensation data of 12 bits compensated by the second gamma curve. For example, the second sample compensation data corresponding to 64 ($2^6$) second sample grayscale data, such as 0, 31, 63, . . . , 2015, and 2047, is stored in the second lookup table LUT2 of the second storage unit 231.

For example, in FIG. 7A, the grayscale data D is 10 bits long, the second compensation data D'2 is 12 bits long and is compensated by the second gamma curve, and FIG. 7A shows the relationship between the grayscale data D and the second compensation data D'2. The second compensation data D'2 relates to the first sample compensation data as shown in FIG. 7B, and is stored in the second lookup table LUT2.

The second compensation unit 237 generates the second compensation data D'2(*i*) using the second compensation data D'2 stored in the second lookup table LUT2 and the first compensation data D'1 provided by the first interpolation unit 213 (step S140).

The second interpolation unit 233 calculates the second compensation data D'2(*i*) as illustrated in Equation 1. Referring to FIG. 8, the second interpolation unit 233 may calculate the second compensation data D'2(*i*) using the n-th and (n+1)-th second compensation data D'2(*n*) and D'2(*n*+1) stored in the second storage unit 231, and the n-th, i-th and (n+1)-th first compensation data D'1(*n*), D'1(*i*) and D'1(*n*+1) provided from the first compensation unit 217, where the value of n and i comprises natural numbers and i comprises a number between n and (n+1).

The DAC 239 receives the second compensation data D'2(*i*) and converts the received second compensation data D'2(*i*) into the second analog data signal d'2(*i*). The DAC 239 outputs the second analog data signal d'2(*i*) to the data line DL electrically connected to the unit pixel Pu (step S150).

A gate signal, which is the gate-on voltage, is applied to the second gate line GL2 electrically connected to the second sub-pixel Ps2 of the unit pixel Pu while the second analog data signal d'2(*i*) is applied to the data line DL. Accordingly, the second sub-pixel Ps2 is driven.

In an exemplary embodiment of the present invention, a display apparatus includes a super patterned vertical alignment ("super-PVA") ("SPVA") mode in which each unit pixel includes two sub-pixels to form a plurality of domains. In the display apparatus, gamma curves, which are different from each other, are applied to the sub-pixels so that a viewing angle may be increased. Also, compensation data having an increased number of bits are applied to the sub-pixels so that a yellowish phenomenon in which the image viewed from the side looks yellowish may be prevented. Further, storage capacity of a memory, which respectively applies different compensation data to the sub-pixels, may be decreased so that manufacturing costs may be reduced.

The present invention should not be construed as being limited to the exemplary embodiments set forth herein. Rather, these exemplary embodiments are provided so that this disclosure will be thorough and complete and will fully convey the concept of the present invention to those skilled in the art.

While the present invention has been particularly shown and described with reference to exemplary embodiments thereof, it will be understood by those of ordinary skill in the art that various changes in form and details may be made therein without departing from the spirit and/or scope of the present invention as defined by the following claims.

What is claimed is:

1. A display apparatus comprising:

a display panel comprising a plurality of unit pixels, each unit pixel of the plurality of unit pixels including a first sub-pixel electrically connected to a data line, the first sub-pixel receives a first gate signal through a first gate line, and a second sub-pixel electrically connected to the data line, the second sub-pixel receives a second gate signal through a second gate line adjacent to the first gate line;

a timing controller comprising a first compensation unit which receives grayscale data corresponding to the plurality of unit pixels and generates first compensation data of the grayscale data using offset values of first sample compensation data sampled from a first gamma curve; and a data driver comprising a second compensation unit which generates second compensation data of the grayscale data using second sample compensation data sampled from a second gamma curve and the first compensation data, wherein the first compensation data is transferred to the first sub-pixel through the data line when the first sub-pixel is turned on by the first gate signal, and the second compensation data is transferred to the second sub-pixel through the data line when the second sub-pixel is turned on by the second gate signal, wherein the first compensation data is applied to the second compensation unit.

2. The display apparatus of claim 1, wherein the data driver converts the first and second compensation data into first and second analog data signals, respectively, and outputs the first and second analog data signals to the first and second sub-pixels, respectively.

3. The display apparatus of claim 1, wherein the first compensation unit comprises:

a first storage unit which stores offset values of the first sample compensation data including both positive and negative first sample compensation data; and a first interpolation unit which calculates first compensation data using the offset values of the first sample compensation data including both positive and negative first sample compensation data.

4. The display apparatus of claim 3, wherein the second compensation unit comprises:

a second storage unit which stores the second sample compensation data; and a second interpolation unit which calculates the second compensation data using the second sample compensation data and the first compensation data.

5. The display apparatus of claim 4, wherein the second interpolation unit calculates the second compensation data of an i-th grayscale data by the following equation, $$D'2(i) = \frac{(D'1(i) - D'1(n1))}{(D'1(n+1)) - (D'1(n))} \times (D'2(n+1) - D'2(n)) + D'2(n)$$

wherein D'2($n$) and D'2($n$+1) respectively include n-th and (n+1)-th second compensation data, D'1($n$), D'1($i$) and D'1($n$+1) respectively include n-th, i-th and (n+1)-th first compensation data, n and i include natural numbers, and i includes a value between n and (n+1).

6. The display apparatus of claim 4, wherein the second storage unit includes a receiving capacity smaller than a receiving capacity of the first storage unit.

7. The display apparatus of claim 1, wherein the received grayscale data include N-bits, the first and second compensation data include (N+k) bits, and N and k include natural numbers.

8. An apparatus for driving a display panel, comprising:

a timing controller comprising a first compensation unit which generates first compensation data of grayscale data using an offset value of first sample data sampled from a first gamma curve; and a data driver comprising a second compensation unit which generates second compensation data of the grayscale data using the first compensation data and second sample compensation data sampled from a second gamma curve different from the first gamma curve, and a digital-to-analog converter to convert the first and second compensation data into first and second analog data signals, respectively, wherein the first compensation data is applied to the second compensation unit.

9. The apparatus of claim 8, wherein the first compensation unit comprises:

a first storage unit which stores offset values of first sample compensation data including both positive and negative first sample compensation data; and a first interpolation unit which calculates the first compensation data using the offset values of first sample compensation data including both positive and negative first sample compensation data.

10. The apparatus of claim 9, wherein the second compensation unit comprises:

a second storage unit which stores the second compensation data; and a second interpolation unit which calculates the second compensation data using the second sample compensation data and the first compensation data.

11. The apparatus of claim 10, wherein the second storage unit includes a receiving capacity smaller than a receiving capacity of the first storage unit.

12. The apparatus of claim 8, wherein the second interpolation unit calculates the second compensation data of an i-th grayscale data by the following equation, $$D'2(i) = \frac{(D'1(i) - D'1(n1))}{(D'1(n+1)) - (D'1(n))} \times (D'2(n+1) - D'2(n)) + D'2(n)$$

wherein D'2($n$) and D'2($n$+1) respectively include n-th and (n+1)-th second compensation data, D'1($n$), D'1($i$) and D'1($n$+1) respectively include n-th, i-th and (n+1)-th first compensation data, n and i include natural numbers, and i includes a value between n and (n+1).

13. The apparatus of claim 8, wherein the grayscale data includes N-bits, the first and second compensation data include (N+k) bits, and N and k include natural numbers.

14. The apparatus of claim 8, wherein the digital-to-analog converter comprises a linear digital-to-analog converter.

15. The apparatus of claim 8, further comprising a gate driver which applies a gate signal to a first gate line and applies the gate signal to a second gate line, which is adjacent to the first gate line, in order to drive a second sub-pixel including a second transistor, wherein the first gate line is connected to a first transistor, which is connected to a data line to drive a first sub-pixel including the first transistor and the second gate line is connected to the second transistor, which is connected to the data line.

16. A method of driving a display panel, the method comprising:

generating first compensation data of grayscale data using offset values of first sample compensation data sampled from a first gamma curve, using a first compensation unit, using a data driver;

converting the first compensation data into a first analog data signal and outputting the first analog data signal to a data line of a display panel;

generating second compensation data of the received grayscale data using second sample compensation data sampled from a second gamma curve and the first compensation data, using a second compensation unit; and converting the second compensation data into a second analog data signal and outputting the second analog data signal to the data line, using the data driver, wherein the first compensation data is applied to the second compensation unit.

17. The method of claim 16, wherein the offset values are different values and the first sample compensation data includes both positive and negative first sample compensation data are stored.

18. The method of claim 16, wherein the first gamma curve is different from the second gamma curve.

19. The method of claim 16, wherein the converting of the first compensation data includes applying a gate signal to a first gate line electrically connected to the data line, in order to drive a first sub-pixel electrically connected to the data line and the first gate line, and the converting of the second compensation data includes applying the gate signal to a second gate line electrically connected to the data line and is adjacent to the first gate line, in order to drive a second sub-pixel electrically connected to the data line and the second gate line.

20. The method of claim 16, wherein the grayscale data include N-bits, the first and second compensation data include (N+k) bits, and N and k include natural numbers.

* * * * *